United States Patent [19]

Focke

[11] 4,250,994

[45] Feb. 17, 1981

[54] CIGARETTE PACK LAMINATE HAVING RAISED SEALING RIDGES

[75] Inventor: Heinz Focke, Verden, Fed. Rep. of Germany

[73] Assignee: Focke & Co., Verden, Fed. Rep. of Germany

[21] Appl. No.: 22,003

[22] Filed: Mar. 19, 1979

[30] Foreign Application Priority Data

Mar. 20, 1978 [DE] Fed. Rep. of Germany ..... 2812059

[51] Int. Cl.[3] ..... B65D 85/10

[52] U.S. Cl. ..... 206/273; 229/48 T

[58] Field of Search ..... 206/271, 273; 229/43, 229/48 T, 48 R, 44 CB

[56] References Cited

U.S. PATENT DOCUMENTS

| | | | |
|---|---|---|---|
| 2,259,822 | 10/1941 | Kienlen | 229/48 R |
| 3,017,067 | 1/1962 | Parks | 229/48 R |
| 3,079,059 | 2/1963 | Kuchenbecker | 229/48 R |
| 3,533,548 | 10/1970 | Taterka | 229/48 T |
| 3,952,868 | 4/1976 | Muller | 206/273 |
| 3,986,607 | 10/1976 | Foche | 206/273 |

FOREIGN PATENT DOCUMENTS

| | | | |
|---|---|---|---|
| 583756 | 9/1933 | Fed. Rep. of Germany | 206/273 |
| 1068146 | 5/1967 | United Kingdom | 229/48 T |

*Primary Examiner*—Herbert F. Ross

*Attorney, Agent, or Firm*—Sughrue, Rothwell, Mion, Zinn and Macpeak

[57] ABSTRACT

A cigarette pack blank made from a laminate and having an outer layer of heat-weldable plastic is provided with raised, elongate ridges or beads 22, 24–26 on various fold flaps to facilitate hermetic sealing by the application of heat and pressure in spite of any minor irregularities or waviness in the planes of the flaps.

8 Claims, 9 Drawing Figures

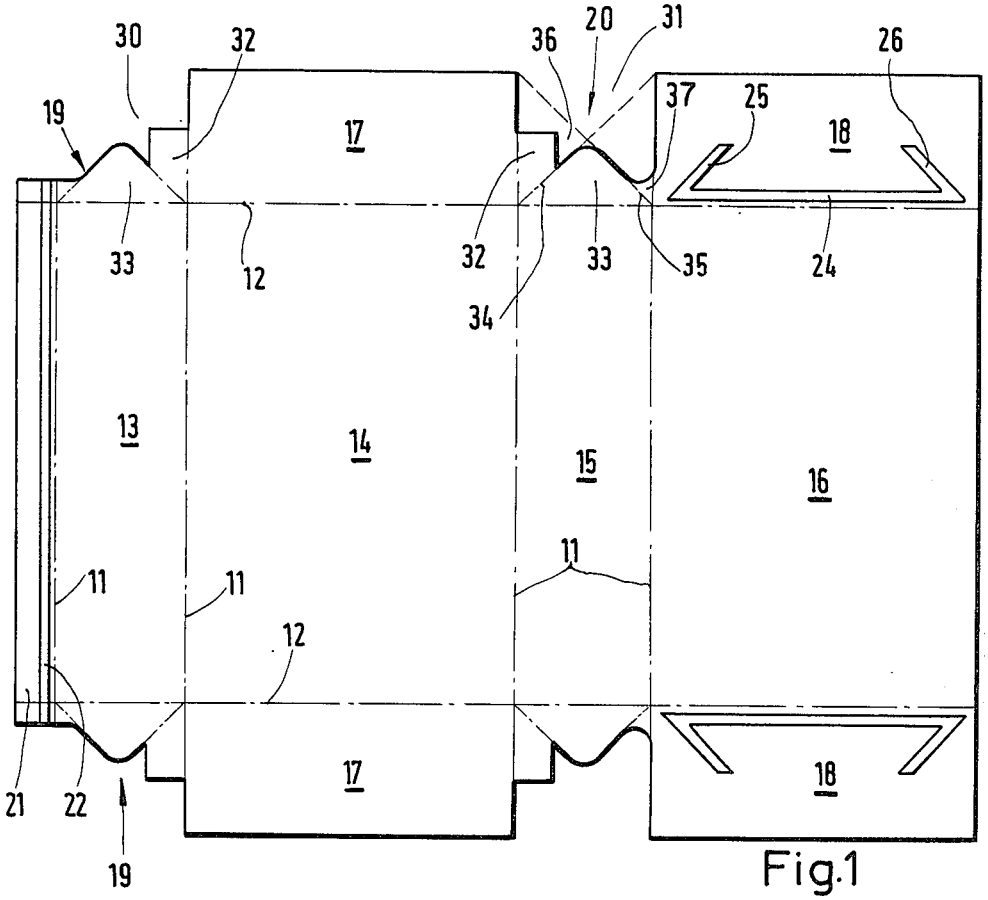
Fig.1
Fig.2
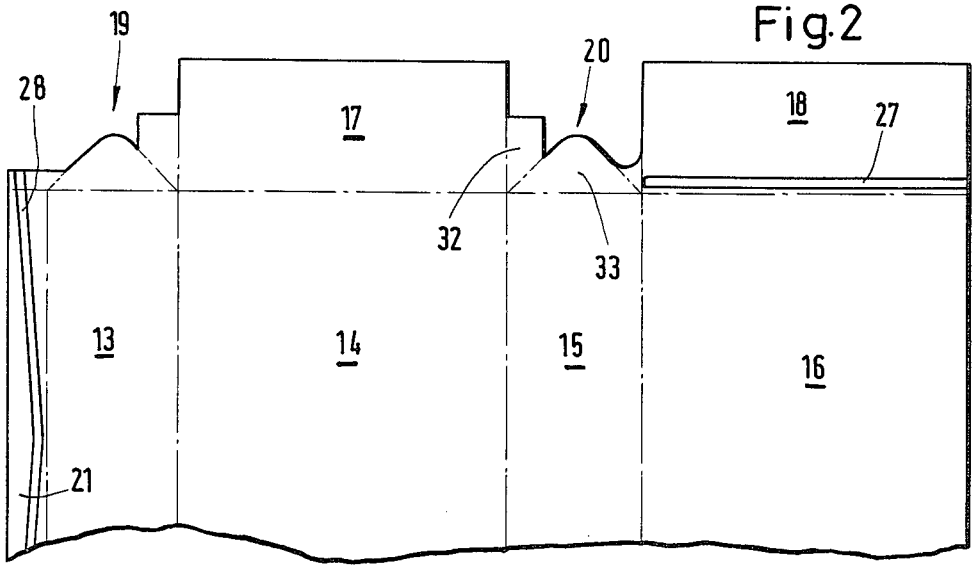

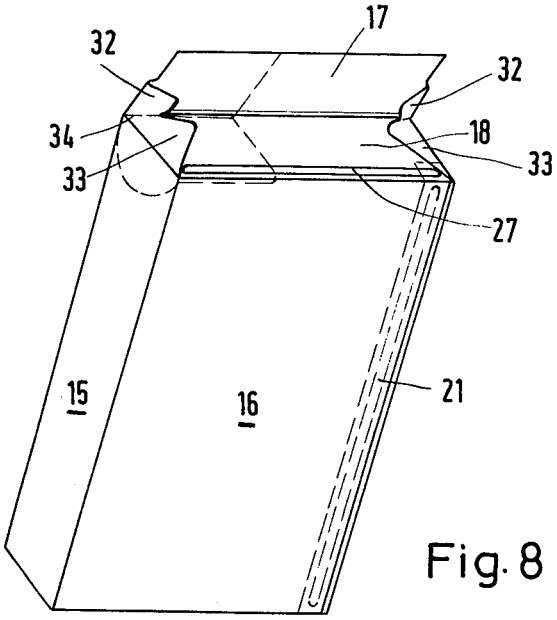
Fig. 8
Fig. 9
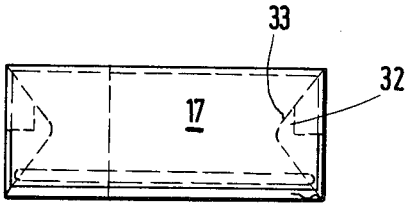

CIGARETTE PACK LAMINATE HAVING RAISED SEALING RIDGES

BACKGROUND OF THE INVENTION

The invention relates to a packet, in particular a cigarette packet, with flaps which can be bonded to one another by pressure and, if necessary, heat, for example tube-forming flaps and closing flaps, the packet preferably consisting of a laminate possessing a heat-weldable outer layer.

Laminates have proved to be a packaging material having particular advantages for the cigarette industry. Using a laminate, substantially air-tight and aroma-tight packets can be produced from a one-piece blank.

In the case of laminates having outer layers or coatings of a heat-weldable plastic, flaps of the blank which are to be bonded to one another are bonded by heat-welding, namely by application of heat and pressure. If the packet is appropriately designed, this welding is used on the one hand for a so-called tube-forming flap, which runs in the longitudinal direction of the packet, and on the other hand for end flaps which form the packet seal in the zone of the end faces.

Subjecting the packets to heat and pressure proves difficult in practice, for various reasons. The contents of the packet are sensitive to exposure to these conditions. In particular, the pressure to be applied must be carefully controlled. On the other hand, the parts of the blank which are to be bonded to one another are not always completely planar. As a result of preceding folding processes, but also as a result of the behavior of the flexible laminate, waviness is encountered in the zone of the flaps which are to be bonded to one another. On the other hand, however, an aroma-tight and air-tight seal can only be achieved, and guaranteed, if the flaps in question are bonded to one another without leaving any gaps.

It is the object of the invention so to design and prepare a packet of the type described, or its blank, that when producing bonds, requiring pressure, between parts of the blank, a bond which is free from gaps, and is tight throughout, can be produced with relatively little pressure.

SUMMARY OF THE INVENTION

To achieve this object, the packet according to the invention is characterized in that at least one of the flaps to be bonded to one another is provided with raised portions on the surface facing the other flap. These raised portions are suited to the geometrical shape of the bond to be achieved between the flaps. Preferably they are beads, ridges or the like which are molded into the packet blank, that is to say in particular into the laminate, for example molded by embossing. In the region of these raised portions, beads and the like, a zone of increased specific surface pressure compared to the adjacent surface portions is produced, preferably with simultaneous plasticization of the surface layers. The bead is at the same time slightly deformed, namely pressed flat at least momentarily. This ensures that the flaps to be bonded to one another are tightly bonded, at least in the zone of this bead, by a linear or strip-shaped bond extending the full length of the bead.

According to the invention, the beads are provided on what are in each case the inner flaps.

The invention further relates to a particular constructional design of a packet, made from a laminate or the like, in the zone of the end-face terminal flaps, in particular in respect of the design of lateral end flaps which adjoin narrow side walls of the cuboid packet. These lateral end flaps, provided with diagonal fold lines, exhibit a weakening of the material in the zone of the fold lines. Such weakening facilitates the folding process in this zone of complex folds. Furthermore, the lateral end flaps are so constructed that the gussets which as a result of the folding process lie over one another are staggered stepwise, relative to one another and relative to the other end flaps, by virtue of different geometrical shape and/or dimensions.

Further characteristics of the invention relate to the constructional design of the packet and of the blank, with a view to achieving a tight seal of the packet.

BRIEF DESCRIPTION OF THE DRAWINGS

Illustrative embodiments of cuboid packets and blanks are explained in more detail below with the aid of the drawings. In these:

FIG. 1 shows a flattened blank for a cuboid packet,

FIG. 2 shows a part-zone of a flattened blank, with some details modified compared to FIG. 1, FIG. 8 shows a cuboid packet for cigarettes or the like, with a partially open end face, in perspective view, and FIG. 9 shows the closed packet according to FIG. 8, in a plan view of the end face.

DETAILED DESCRIPTION OF THE PREFERRED EMBODIMENTS

Figure 3:
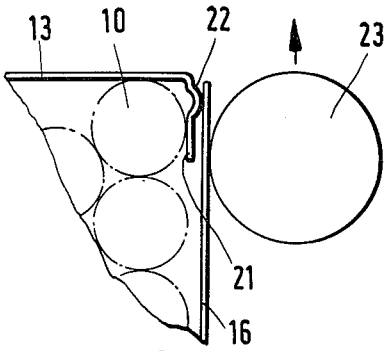
FIG. 3 shows a horizontal section through a corner zone of a cuboid packet for cigarettes.

The illustrated embodiments of blanks and packets relate to laminates having outer, heat-weldable layers, and to cuboid packets for cigarettes 10.

The one-piece blank according to FIG. 1 consists of several zones, marked by longitudinal fold lines 11 and transverse fold lines 12, for forming walls of the packet. A first side wall 13, a front wall 14, a second side wall 15 and a rear wall 16 are formed successively. On the narrow sides of the abovementioned walls or zones there adjoin end flaps which are folded into the plane of the end faces so as to form end-face seals. In the zone of the front wall 14, there adjoins an outer longitudinal end flap 17. The rear wall 16 is provided with inner longitudinal end flaps 18. In the zone of the narrower side walls 13 and 15, special lateral end flaps 19, 20 are formed. In the present case, the longitudinal end flaps 17 and 18 are of such size that they completely cover the end faces of the packet.

In the illustrative embodiment shown, the packet is so constructed that in an intermediate position the blank surrounds, in the manner of a tube, the contents of the packet (a group of cigarettes 10). To form this tube, a continuous tube-forming flap 21 is formed on one free longitudinal edge, in the present instance on the longitudinal side of the free side wall 13. To form the packet tube, the edge of the flap is bonded to the rear wall 16 on the inside (FIG. 3).

Thereafter, the end flaps 17 . . . 20, which initially project beyond the contents of the packet, are folded into the end faces, in such a way that the inner longitudinal end flap 18 is located on the inside, that is to say rests against the contents of the packet, after which the lateral end flaps 19 and 20 are folded onto this inner longitudinal end flap 18, and finally the outer longitudinal end flap 17 is folded so as to form the outer cover. In order to form a tight packet, the folded end flaps 17 . . . 20 are also bonded to one another in a particular manner.

The surface zones which have beforehand been heat-activated are bonded, and welded, to one another by pressing them together. In order to achieve continuous, uninterrupted sealing lines or strips, selected zones of the blank are provided with molded-in raised portions, namely with gutter-shaped beads.

In the zone of the tube-forming flap 21, a longitudinal bead 22 runs at least the full length or height of the packet, though in the illustrative embodiments according to FIGS. 1 and 2 it runs the entire length of the tube-forming flap 21, which in this case is extended into the zone of the end flaps 17 . . . 20. The longitudinal bead 22 is molded into the tube-forming flap 21, by embossing or the like, in such a way that the raised portion faces the inside of the rear wall 16 and rests against the latter (FIG. 3). If now a pressure device, for example a pressure roller 23, is moved over this bonding zone, a certain deformation of the longitudinal bead 22, in the sense of a momentary flattening thereof, results. The local, namely line-shaped, bulge of material has the effect that the outer flap, namely the rear wall 16, is pressed against the longitudinal bead 22, and bonded thereto, over the entire length, without interruption.

Figure 4:
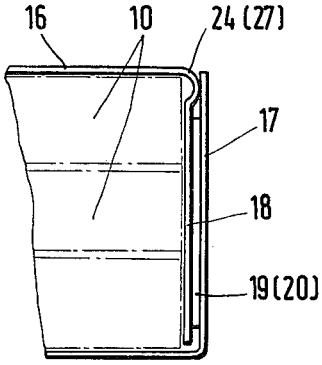
FIG. 4 shows a vertical section through an end-face zone of a cuboid packet for cigarettes.

Entirely analogously, in the illustrative embodiments shown, the inner longitudinal end flap 18 is provided with a transverse bead 24 and, adjoining the latter, diagonally directed bead arms 25 and 26. These beads 24 . . . 26 are so arranged and constructed, that in the closed position (FIG. 4) the outer longitudinal end flap 17 rests against the inner longitudinal end flap 18, namely against the beads 24 . . . 26 thereof, outside the zone of the folded-in lateral end flaps 19, 20. Accordingly, the beads also serve the purpose of bridging a height difference resulting from folded-in layers. As a result of bonding the outer longitudinal end flap 17 to the inner longitudinal end flap 18 along the transverse bead 24, located near the edge and running approximately the full length, and the angularly directed bead arms 25, 26, and also as the result of an additional welding of the outer longitudinal end flap 17 to the folded-in lateral end flaps 19, 20, a completely tight seal results in the zone of the end faces.

In the modification of the blank or packet according to FIG. 2, the transverse bead 27 at the edge of the inner longitudinal end flap 18 extends over the full length of the latter, as a result of which a tight line-shaped or strip-shaped seal is ensured in the present case also.

Figure 6:
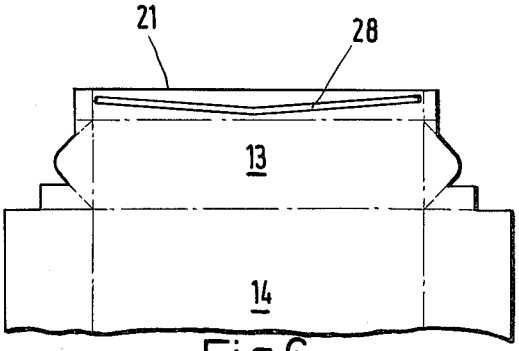
Figure 7:
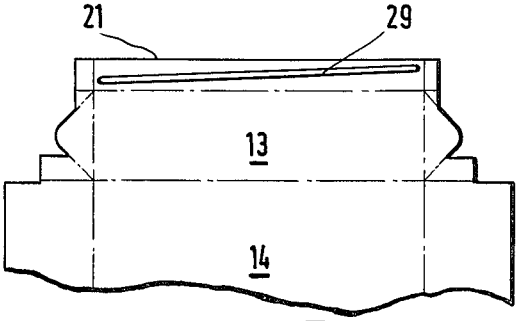

The beads need not necessarily be of rectilinear shape. FIGS. 2, 6 and 7 show examples of a different geometrical shape of the longitudinal bead in the zone of the tube-forming flap 21.

Figure 5:
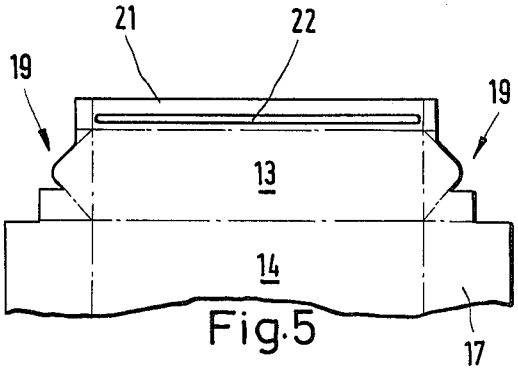
FIGS. 5 to 7 show part-zones of a blank with differing details.

In the proposal according to FIGS. 2 and 5, the longitudinal bead 28 consists of two portions which run in a V-shape relative to one another. If, accordingly, the longitudinal bead 28 is not contacted over its entire length if the pressure applied, for example, by a pressure roller 23, should drift, a progressive, more or less point-shaped pressure results in the arms 25, 26. Completely analogously, a drifting point-shaped or two-dimensional application of pressure results in the zone of a longitudinal bead 29 according to FIG. 7. This bead runs rectilinearly, but is inclined, that is to say at an angle to the longitudinal fold lines 11, within the tube-forming flap 21.

Such beads or similar local raised portions are always advantageous if exposure to pressure is needed in order to bond two parts of a blank, that is to say, for example, also where the gluing of such blanks is concerned.

In the present case, the lateral end flaps 19, 20 are of a special construction. As a result of punched-out portions 30, 31, the lateral end flaps 19, 20 are recessed, in the direction of the longitudinal fold lines 11, relative to the dimensions of the longitudinal end flaps 17, 18. Two different gussets 32 and 33 are formed thereby. These are delimited from one another by a diagonal fold line 34. The geometrical shape of the gussets 32, 33 is such that the substantially triangular gusset 33 adjoins the side wall 13 or 15. The free edges of this gusset are in the zone of the diagonal fold line 34 and of a corresponding, intersecting diagonal fold line 35. The gusset 32 which adjoins a longitudinal end flap, namely the outer longitudinal end flap 17, is of substantially trapezoid shape. The gussets 32, 33 thus formed are folded onto one another, along the diagonal fold line 34, in the finished packet, and as a result of the very different geometrical shape the edges of the gussets 32, 33 are clearly staggered relative to one another. As a result, exclusively single-layer steps result at the free edges of the gussets 32, 33, in particular also relative to the longitudinal end flaps 17, 18.

As a result of the shape of the gussets 32, 33, a wedge-shaped incision 36 is furthermore formed as an extension of the diagonal fold line 34. This incision constitutes a clear fold mark and facilitates the folding of the gussets 32, 33, which are of relatively small area.

The gusset 33 is connected by a corner connection 37 to the inner longitudinal end flap 18, so that this corner also remains tight in the folded packet.

FIGS. 8 and 9 represent a cuboid packet for cigarettes or the like, which consists of a blank of the type of FIG. 5, but with an end-face transverse bead 27 analogously to FIG. 2. As may be seen, a "tubular" sleeve is first formed, by bonding the tube-forming flap 21 to the rear wall 16. The longitudinal bead 22, which extends over the height of the packet, here ensures a bond which is sealed along its entire length.

In the zone of the end faces, the inner longitudinal end flap 18 is folded directly against the packet contents. The lateral end flaps 19 and 20, or their gussets 32, 33, are then folded onto the longitudinal end flap 18. The gusset 33 hereupon rests directly on the longitudinal end flap 18, whilst the gusset 32, folded into the diagonal fold line 34, rests on the first-mentioned gusset 33. As a result of the differing geometrical shape, a distinct staggering of the free edges of the gussets 32 and 33 results (FIG. 9).

Simultaneously with the folding of the lateral end flaps 19 and 20, the folding-over of the outer longitudinal end flap 17 is initiated, so that the latter substantially covers the entire end face. The outer longitudinal end flap 17 is at the same time bonded to the longitudinal end flap 18, at least in the zone of the transverse bead 27 located at the edge.

I claim:

1. A cigarette pack made from a laminated blank having a thermally weldable outer layer with raised resiliently deformable linear bead portions oriented for sealed pack closure purposes the blank having surface portions of equal length defining a narrow width tube forming flap (21), side walls, a front wall and a rear wall (16), and adapted to be folded into a rectangular tube surrounding a group of cigarettes (10) with the tube forming flap underlying the sealed to an inner free edge of one of the walls, the blank further having end closing flaps (17–20) adjoining the front, side and rear walls, projecting out beyond the group of cigarettes, and folded against the ends of the group of cigarettes and sealed to each other, characterized by:

(a) One of the tube forming flap and the inner free edge of said one of the walls having one of said raised linear beads directed toward the other of the tube forming flap and the inner free edge of said one of the walls and extending continuously across the full length thereof, and (b) the bead being completely overlaid by the other of the tube forming flap and the inner free edge of said one of the walls to ensure a continuous sealing contact in spite of any minor planar irregularities or waviness.

2. Pack according to claim 1, wherein the bead runs in the direction of the longitudinal dimension of the tube forming flap.

3. Pack according to claim 1, wherein the bead runs at least in part at an angle to the lateral limit of the tube forming flap.

4. Pack according to claim 1, further including folded gussets (32, 33), and wherein a raised bead (24) having angled end arms (25, 26) which lie outside the zone of said folded gussets (32, 33) is provided on one of said end closing flaps.

5. Pack according to claim 1, further including an edge zone of a wide longitudinal end flap (18), said edge zone also being provided with a raised elongated bead.

6. Pack according to claims 1 or 5, wherein each raised bead is located on an inner flap.

7. Pack according to claim 1, wherein the bead is constructed so as to be resiliently deformable.

8. Pack according to claim 1, wherein the raised bead is constructed as a deformation embossed into the flap as an elongate groove.

* * * * *